US008356654B2

(12) United States Patent
Coleman et al.

(10) Patent No.: US 8,356,654 B2
(45) Date of Patent: Jan. 22, 2013

(54) METHODS OF FORMING AND INSTALLING OVERHEAD SUPPORT SYSTEMS FOR MOVABLE PARTITION SYSTEMS

(75) Inventors: W. Michael Coleman, Salt Lake City, UT (US); Michael D. George, Kaysville, UT (US); Mark B. Laraway, West Jordan, UT (US)

(73) Assignee: Won-Door Corporation, Salt Lake City, UT (US)

( * ) Notice: Subject to any disclaimer, the term of this patent is extended or adjusted under 35 U.S.C. 154(b) by 0 days.

(21) Appl. No.: 13/294,420

(22) Filed: Nov. 11, 2011

(65) Prior Publication Data

US 2012/0055003 A1 Mar. 8, 2012

Related U.S. Application Data

(62) Division of application No. 12/758,563, filed on Apr. 12, 2010, now Pat. No. 8,240,354.

(51) Int. Cl.
*E05F 11/00* (2006.01)

(52) U.S. Cl. ..... 160/188; 160/196.1; 104/95

(58) Field of Classification Search ..... 160/196.1, 160/199, 193, 206, 188; 52/243.1; 198/683; 474/140; 16/96 R, 95 R, 89 B, 87 R, 93 D; 104/172.1, 95, 89, 172.4, 165, 93, 245
See application file for complete search history.

(56) References Cited

U.S. PATENT DOCUMENTS

| | | | |
|---|---|---|---|
| 1,043,492 | A | 11/1912 | Werner et al. |
| 2,464,169 | A | 3/1949 | Bentley |
| 2,693,637 | A | 11/1954 | Peabody et al. |
| 3,074,356 | A | 1/1963 | Parker et al. |
| 3,105,537 | A | 10/1963 | Foster |
| 3,209,439 | A | 10/1965 | Arbogast |
| 3,328,996 | A | 7/1967 | Pin et al. |
| 3,673,845 | A | 7/1972 | Vercoglio |
| 3,753,635 | A | 8/1973 | Barnett |
| 3,783,930 | A | 1/1974 | Williams |
| 4,006,619 | A | 2/1977 | Anderson |
| 4,285,095 | A | 8/1981 | Janson |
| 4,462,950 | A | 7/1984 | Nilsson et al. |
| 4,493,203 | A | 1/1985 | Wheeler et al. |

(Continued)

FOREIGN PATENT DOCUMENTS

| | | | |
|---|---|---|---|
| DE | 202005000165 | U1 | 3/2006 |
| GB | 2086983 | A | 5/1982 |

(Continued)

OTHER PUBLICATIONS

Goodman et al., U.S. Appl. No. 07/215,413, filed Jul. 5, 1988, entitled :Motorized Folding Door Lead Post Assembly and Apparatus for Monitoring Door Position, abandoned.

(Continued)

*Primary Examiner* — Blair M. Johnson
(74) *Attorney, Agent, or Firm* — TraskBritt

(57) ABSTRACT

Movable partition systems may include a chain guide structure extending along a curved path. The chain guide structure may have a specified maximum width, and may include attachment flanges that project laterally from a central beam beyond laterally outward ends of chain guide members of the chain guide structure by a specified minimum distance. Overhead support systems for movable partition systems may include such chain guide structures. Methods of forming overhead support systems and movable partition systems may include stretch forming a bent chain guide structure. Methods of installing overhead support systems and movable partition systems may include inserting fasteners at least substantially perpendicularly through attachment flanges of a chain guide structure to secure the chain guide structure to an overhead structure.

9 Claims, 6 Drawing Sheets

U.S. PATENT DOCUMENTS

| | | | |
|---|---|---|---|
| 4,704,886 | A | 11/1987 | Evert et al. |
| 4,803,878 | A | 2/1989 | Moroney |
| 4,834,161 | A | 5/1989 | Johnson et al. |
| 4,924,929 | A | 5/1990 | Johnson et al. |
| 4,970,886 | A | 11/1990 | Sikora et al. |
| 5,214,951 | A | 6/1993 | Waddell |
| 5,323,631 | A | 6/1994 | Weykamp et al. |
| 5,327,765 | A | 7/1994 | Weykamp et al. |
| 5,349,839 | A | 9/1994 | Weykamp et al. |
| 5,351,517 | A | 10/1994 | Spath |
| 5,419,260 | A | 5/1995 | Hamilton |
| 5,502,997 | A | 4/1996 | Boettger et al. |
| 5,564,303 | A | 10/1996 | Buchanan et al. |
| 5,638,639 | A | 6/1997 | Goodman et al. |
| 5,735,160 | A | 4/1998 | VanSumeren et al. |
| 6,629,386 | B1 | 10/2003 | Cornell et al. |
| 6,662,848 | B2 | 12/2003 | Goodman et al. |
| 7,050,283 | B2 | 5/2006 | Field et al. |
| 7,066,297 | B2 | 6/2006 | Goodman et al. |
| 7,190,132 | B2 | 3/2007 | Goodman et al. |
| 7,478,663 | B2 | 1/2009 | Goodman et al. |
| 7,513,293 | B2 | 4/2009 | Goodman et al. |
| 7,656,129 | B2 | 2/2010 | Banta et al. |
| 2007/0163323 | A1 | 7/2007 | Polen et al. |
| 2008/0023152 | A1 | 1/2008 | Goodman et al. |
| 2008/0105387 | A1 | 5/2008 | Coleman et al. |
| 2008/0105389 | A1 | 5/2008 | Goodman et al. |
| 2008/0115896 | A1 | 5/2008 | Goodman |
| 2008/0169069 | A1 | 7/2008 | Coleman et al. |
| 2008/0197808 | A1 | 8/2008 | Banta et al. |
| 2008/0244991 | A1 | 10/2008 | Coleman et al. |
| 2009/0044918 | A1 | 2/2009 | Goodman et al. |
| 2009/0120595 | A1 | 5/2009 | Goodman et al. |
| 2009/0188633 | A1 | 7/2009 | Goodman et al. |
| 2011/0061819 | A1 | 3/2011 | Elinson |

FOREIGN PATENT DOCUMENTS

| | | | |
|---|---|---|---|
| WO | 2005/098189 | A1 | 10/2005 |

OTHER PUBLICATIONS

Goodman et al., U.S. Appl. No. 07/215,413, filed Jul. 5, 1988, entitled: Motorized Folding Door Lead Post Assembly and Apparatus for Monitoring Door Position, abandoned.

METHODS OF FORMING AND INSTALLING OVERHEAD SUPPORT SYSTEMS FOR MOVABLE PARTITION SYSTEMS

CROSS-REFERENCE TO RELATED APPLICATION

This application is a divisional of U.S. patent application Ser. No. 12/758,563, filed Apr. 12, 2010, now U.S. Patent No. 8,240,354, issued Aug. 14, 2012, the disclosure of which is hereby incorporated herein by this reference in its entirety.

TECHNICAL FIELD

Embodiments of the present invention are directed to the field of movable partitions used for one or more of partitioning space, as sound barriers, as fire barriers, security barriers, or for various other applications.

BACKGROUND

Movable partitions are utilized in numerous situations and environments for a variety of purposes. Such partitions may include, for example, a movable partition comprising foldable or collapsible doors configured to enclose or subdivide a room or other area. Often such partitions may be utilized simply for purposes of versatility in being able to subdivide a single large room into multiple smaller rooms. The subdivision of a larger area may be desired, for example, to accommodate multiple groups or meetings simultaneously. In other applications, such partitions may be utilized for noise control depending, for example, on the activities taking place in a given room or portion thereof.

Movable partitions may also be used to provide a security barrier, a fire barrier, or both a security barrier and a fire barrier. In such a case, the partition barrier may be configured to automatically close upon the occurrence of a predetermined event such as the actuation of an associated alarm. For example, one or more accordion or similar folding-type partitions may be used as a security barrier, a fire barrier, or both a security barrier and a fire barrier wherein each partition is formed with a plurality of panels connected to one another with hinges. The hinged connection of the panels allows the partition to fold and collapse into a compact unit for purposes of storage when not deployed. The partition may be stored in a pocket formed in the wall of a building when in a retracted or folded state. When the partition is deployed to subdivide a single large room into multiple smaller rooms, secure an area during a fire, or for any other specified reason, the partition may be extended along an overhead track, which is often located above the movable partition in a header assembly, until the partition extends a desired distance across the room.

When deployed, a leading end of the movable partition, often defined by a component known as a lead post, complementarily engages a another structure, such as a wall, a post, or a lead post of another door.

Automatic extension and retraction of the movable partition may be accomplished through the use of a motor located in a pocket formed in the wall of a building in which the movable partition is stored when in a retracted or folded state. The motor, which remains fixed in place within the pocket, may be used to drive extension and retraction of the movable partition. A motor for automatically extending and retracting a movable partition may also be mounted within the movable partition itself, such that the motor travels with the movable partition as the movable partition is extended and retracted using the motor.

BRIEF SUMMARY

In some embodiments, the present invention includes movable partition systems that include an overhead support system extending along a curved path and a movable partition coupled to the overhead support system. The overhead support system may include an elongated chain guide structure extending along a curved path. The elongated chain guide structure may have a maximum width of at least about sixty millimeters (60 mm), and may include a longitudinally extending and vertically oriented central beam, a pair of attachment flanges extending laterally from a top end of the central beam, and a pair of chain guide members extending laterally from the central beam vertically below the pair of attachment flanges. The attachment flanges of the pair of attachment flanges may project laterally outward from the central beam beyond laterally outward ends of the chain guide members of the pair of chain guide members by at least about eight millimeters (8 mm).

In additional embodiments, the present invention includes overhead support systems for movable partition systems. The overhead support systems include an elongated chain guide structure that has a plurality of curved segments each comprising a stretch-formed unitary body. The stretch-formed unitary body of each segment of the plurality of curved segments includes a longitudinally extending and vertically oriented central beam, a pair of attachment flanges extending laterally from a top end of the central beam, and a pair of chain guide members extending laterally from the central beam vertically below the pair of attachment flanges. The attachment flanges of the pair of attachment flanges project laterally outward from the central beam beyond laterally outward ends of the chain guide members of the pair of chain guide members.

In additional embodiments, the present invention includes methods of forming an overhead support system for a movable partition system. An at least substantially straight elongated unitary body may be formed, and the elongated unitary body may be bent while applying a tensile force to the elongated unitary body that results in tension within the elongated unitary body higher than a yield point of a material of the elongated unitary body. In forming the elongated unitary body, a longitudinally extending and vertically oriented central beam may be formed. A pair of attachment flanges may be formed that extend laterally from a top end of the central beam. A pair of chain guide members may be formed that extend laterally from the central beam vertically below the pair of attachment flanges. The attachment flanges of the pair of attachment flanges may be formed to project laterally outward from the central beam beyond laterally outward ends of the chain guide members of the pair of chain guide members.

In yet further embodiments, the present invention includes methods of installing overhead support systems for movable partition systems. In accordance with such methods, an at least substantially straight elongated unitary body may be formed. The elongated unitary body then may be bent while applying a tensile force to the elongated unitary body that results in tension within the elongated unitary body higher than a yield point of a material of the elongated unitary body. Fasteners may be inserted at least substantially perpendicularly through the attachment flanges of the pair of attachment flanges and at least substantially parallel to the central beam to secure the elongated unitary body to an overhead structure. In forming the unitary body, a longitudinally extending and vertically oriented central beam may be formed, a pair of attachment flanges may be formed that extend laterally from a top end of the central beam, and a pair of chain guide members may be formed that extend laterally from the central beam vertically below the pair of attachment flanges. The attachment flanges of the pair of attachment flanges may be formed to project laterally outward from the central beam beyond laterally outward ends of the chain guide members of the pair of chain guide members.

BRIEF DESCRIPTION OF THE SEVERAL VIEWS OF THE DRAWINGS

While the specification concludes with claims particularly pointing out and distinctly claiming what are regarded as embodiments of the present invention, the advantages of the embodiments of the invention may be more readily ascertained from the description of embodiments of the invention when read in conjunction with the accompanying drawings, in which:

DETAILED DESCRIPTION

Illustrations presented herein are not meant to be actual views of any particular movable partition system, or component of a movable partition system, but are merely idealized representations which are employed to describe embodiments of the present invention. Additionally, elements common between figures may retain the same numerical designation.

Figure 1:
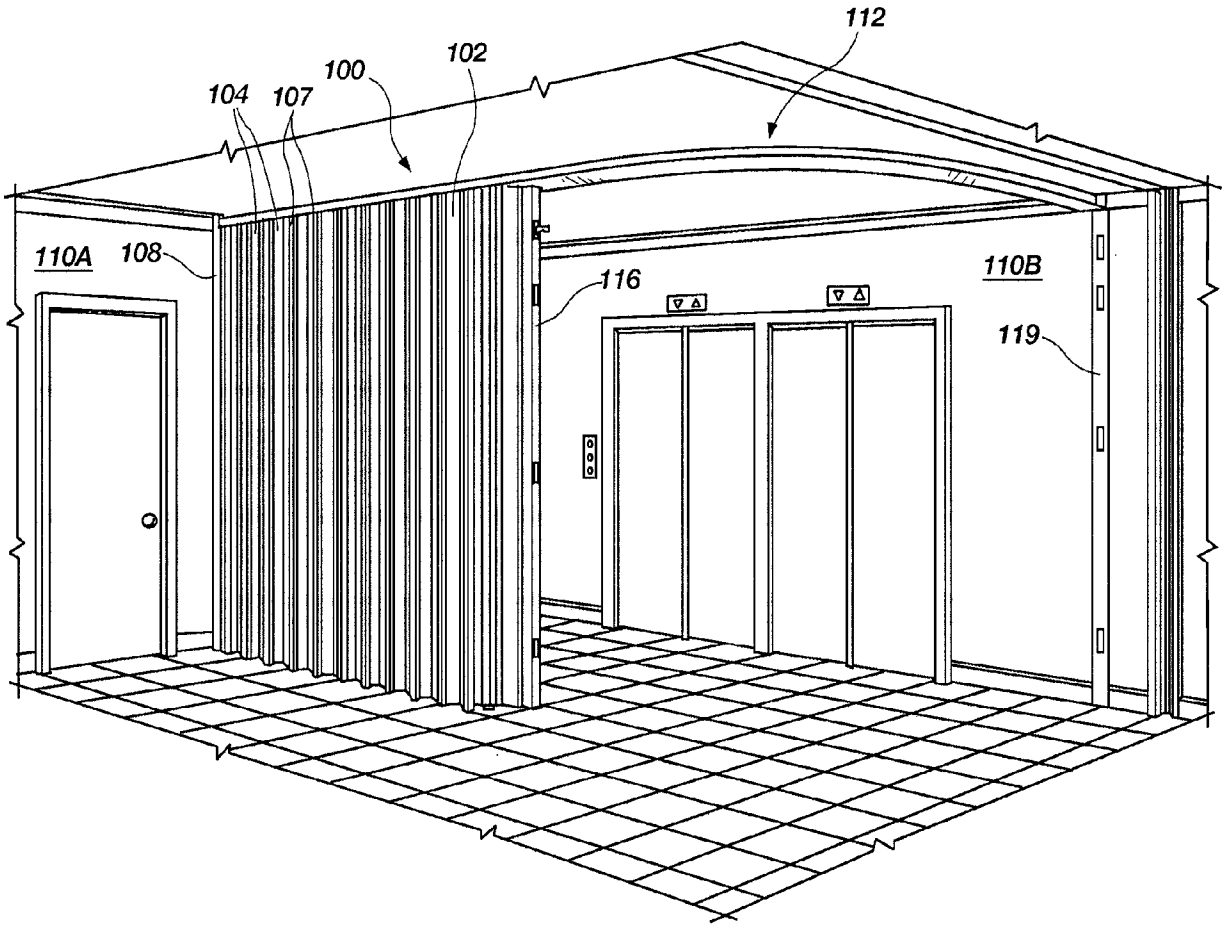
FIG. 1 is a perspective view of an embodiment of a movable partition system of the present invention.

FIG. 1 illustrates an embodiment of a movable partition system 100 of the present invention for extending along a curved path through a space within a building or other enclosure. The movable partition system 100 is an automatic movable partition system, in that the system 100 includes a movable partition 102 that may be automatically extended, automatically retracted, or both automatically extended and automatically retracted. The movable partition 102 also may be manually extended, manually retracted, or both manually extended and manually retracted. The movable partition 102 may be used for one or more of partitioning space, as a sound barrier, as a fire barrier, as a security barrier, for combinations of such purposes, or for other purposes.

Figure 2:
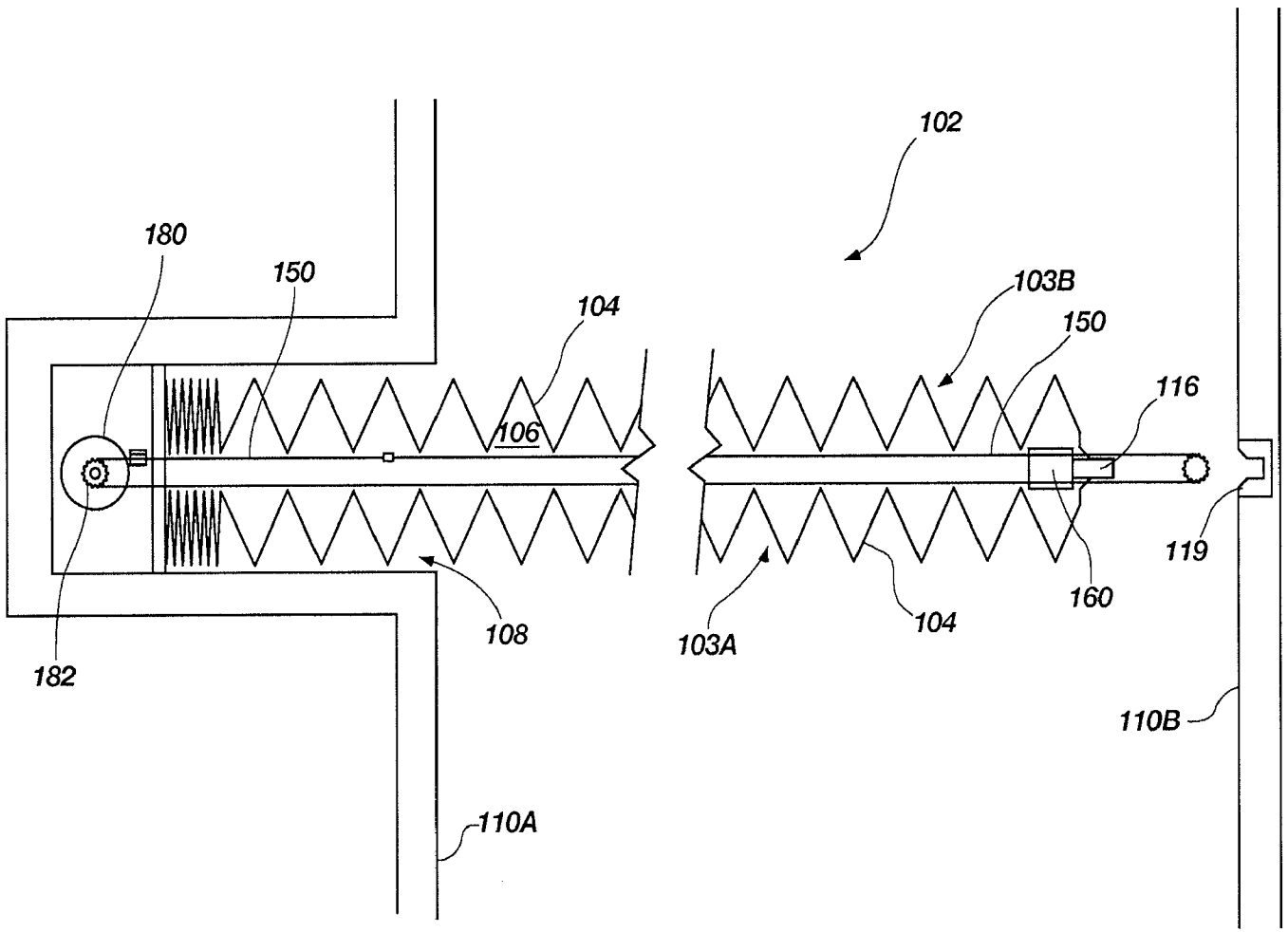
FIG. 2 is a simplified horizontal cross-sectional view of a movable partition of the movable partition system of FIG. 1.

The movable partition 102 may comprise, for example, an accordion-type door, as shown in FIGS. 1 and 2. Referring to FIG. 2, the movable partition 102 may include two sheets 103A, 103B of panels 104. The sheets 103A, 103B may extend side-by-side along one another in a generally parallel fashion, such that an interior space 106 is defined within the movable partition 102 at least when the movable partition 102 is in the extended state. Each sheet 103A, 103B may comprise a plurality of panels 104, which may be connected to one another with hinges or other hinge-like members 107 (FIG. 1). The hinged connection of the panels 104 allows the panels 104 of each sheet 103A, 103B to fold back and forth over one another, and the movable partition 102 to collapse as the movable partition 102 is retracted, which allows the movable partition 102 to be compactly stored in a pocket 108 formed in a wall 110A of a building when in a retracted or folded state. In other embodiments, the movable partition 102 may comprise another type of movable partition.

FIG. 2 is a simplified horizontal cross-sectional view of the movable partition 102 shown in FIG. 1. As shown in FIG. 2, the leading ends of the first sheet 103A and the second sheet 103B of panels 104 may be coupled to a lead post 116. The lead post 116 may be configured to matingly (i.e., complementarily) engage with a jamb or door post 119 that may be formed in another wall 110B of a building, when the movable partition 102 is in a deployed or an extended state. In other embodiments, the male lead post 116 may also matingly engage with a female lead post (not shown) of another movable partition (not shown) of the movable partition system 100. Such an additional movable partition with the female lead post (not shown) may also be configured to move automatically and/or manually.

When it is desired to deploy the movable partition 102 to an extended position, the movable partition 102 is driven along a track or track system that extends through a curved path across the space to provide an appropriate barrier.

Figure 3:
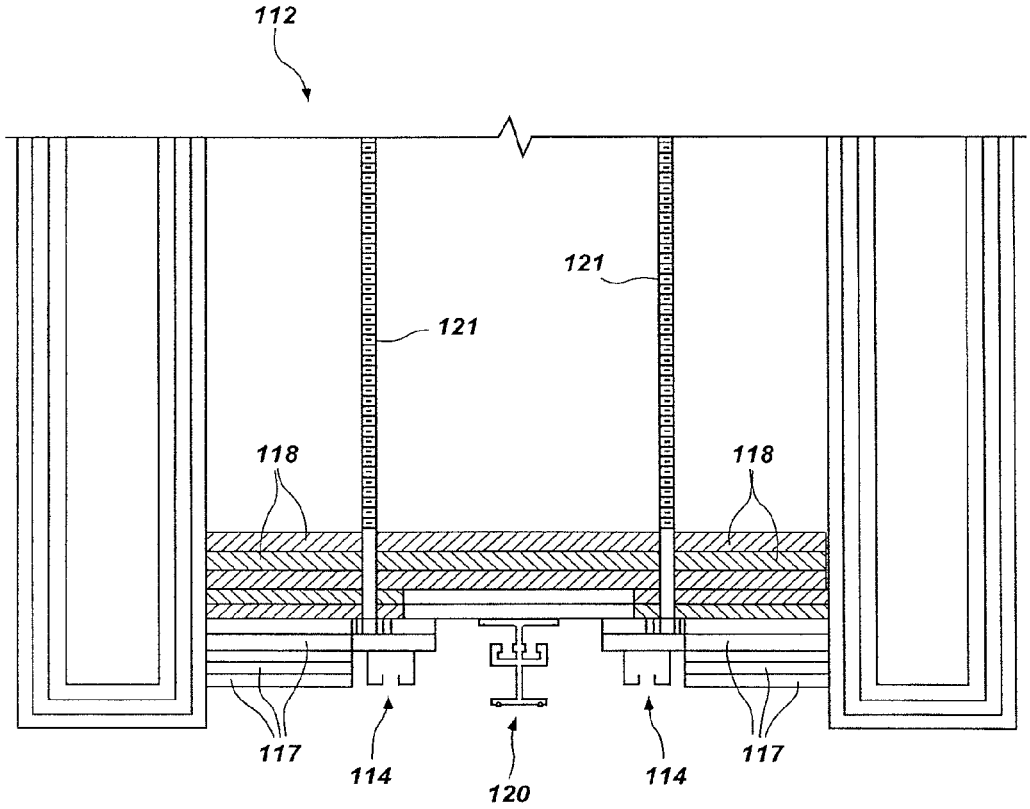
FIG. 3 is a transverse cross-sectional view of a support system of the movable partition system of FIG. 1.

In some embodiments, the movable partition 102 may be suspended from (i.e., hang from) an overhead support system 112 (FIG. 1). FIG. 3 is a transverse cross-sectional view of an overhead support system 112 that may be used in embodiments of the present invention. The overhead support system 112 includes two tracks 114, each of which is configured to support rollers (not shown) therein that are attached to one of the sheets 103A, 103E of panels 104, respectively. Thus, the sheets 103A, 103B of panels 104 may move along the tracks 114 by the rolling of rollers within and along roller channels within the tracks 114. Such rollers are disclosed in, for example, U.S. Patent Application Publication No. 2008/0115896 A1 by Goodman, which published May 22, 2008, now U.S. Pat. No. 8,087,444, issued Jan. 3, 2012; U.S. Patent Application Publication No. 2008/0169069 A1 by Coleman et al., which published Jul. 17, 2008, now U.S. Pat. No. 7,926,538, issued Apr. 19, 2011; and U.S. Patent Application Publication No. 2009/0188633 A1 by Goodman et al., which published Jul. 30, 2009, now U.S. Pat. No. 7,886,804, issued Feb. 15, 2011; and U.S. Patent Application Publication No. 2008/0244991 A1 by Coleman et al., which published Oct. 9, 2009, now U.S. Pat. No. 7,854,248, issued Dec. 21, 2010, the disclosure of each of which is incorporated herein in its entirety by this reference.

The overhead support system 112 further includes an elongated chain guide structure 120 that extends longitudinally along the curved path between the tracks 114. Each of the elongated chain guide structure 120 and the tracks 114 may comprise a plurality of segments (having respectively identical cross-sectional shapes) that are longitudinally aligned with one another and extend end-to-end along the curved path. The tracks 114 and the chain guide structure 120 may be attached to a layered assembly comprising, for example, one or more layers of fire resistant material 117 (e.g., sheet rock, metal, etc.), as well as one or more layers of structural support material 118 (e.g., wood, plywood, etc.). The layers of fire resistant material 117 and the layers of structural support material 118 may be suspended from a ceiling using, for example, elongated rod members 121.

Figure 4:
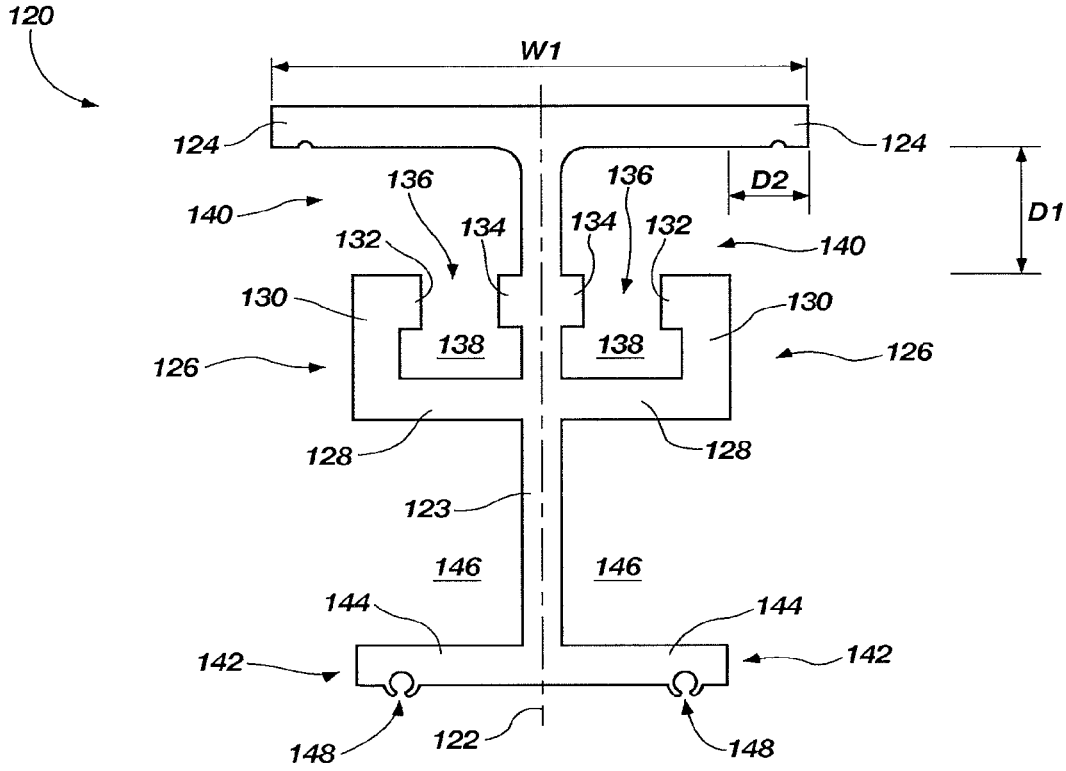
FIG. 4 is an enlarged transverse cross-sectional view of a chain guide of the support system shown in FIG. 3.

FIG. 4 is an enlarged transverse cross-sectional view of the chain guide structure 120 of the support system 112 shown in FIG. 3. Each segment of the chain guide structure 120 may comprise an elongated metal or metal alloy structure. For example, each segment of the chain guide structure 120 may comprise an aluminum-based alloy or an iron-based alloy (e.g., steel). Each segment of the chain guide structure 120 may comprise a unitary body that has been formed using, for example, an extrusion process. Furthermore, each unitary body may have an at least substantially homogenous material composition.

As shown in FIG. 4, each segment of the chain guide structure 120 may be symmetric about a plane 122 extending longitudinally through the center of the of the chain guide structure 120. The chain guide structure 120 may comprise a vertically extending central beam 123. The chain guide structure 120 may comprise two attachment flanges 124 that extend laterally from the central beam 123. The attachment flanges 124 may be used to attach the chain guide structure 120 to another component of the overhead support system 112 (e.g., a header or header assembly). For example, screws, bolts, or nails may be passed vertically through the attachment flanges 124 (e.g., at least substantially perpendicular to the attachment flanges 124 and parallel to the central beam 123) and into another component of the overhead support system 112 to secure the chain guide structure 120 to the overhead support system 112, as discussed in further detail below.

The chain guide structure 120 also may comprise a chain guide member 126 on each lateral side of the central beam 123. Each chain guide member 126 may include a laterally extending portion 128 and a vertically extending portion 130. In this configuration, chain channels 138 may be defined on each side of the central beam 123 by the spaces over the laterally extending portions 128 of the chain guide member 126 and between the central beam 123 and the vertically extending portions 130 of the chain guide member 126. The chain guide members 126 may also include protrusions 132 on the vertically extending portions 130 that protrude laterally inward toward the central beam 123, and protrusions 134 may be provided on the lateral sides of the central beam 123 that protrude laterally outward toward the vertically extending portions 130 of the chain guide members 126. In this configuration, slots 136 may be defined between the protrusions 132 and the protrusions 134 vertically over the chain channels 138. The slots 136 may have a lateral width that is smaller than the lateral width of the chain channels 138, which may hinder or prevent a drive chain positioned within a chain channel 138 from being displaced out from the chain channel 138 unintentionally.

With continued reference to FIG. 4, the minimum distances D1 between the tops of the vertically extending portions 130 of the chain guide members 126 and the lower surfaces of the attachment flanges 124 define openings 140 to the slots 136 and the chain channels 138. In some embodiments of the invention, these minimum distances D1 may be about eighteen millimeters (18 mm) or more, about twenty millimeters (20 mm) or more, or even about twenty-two millimeters (22 mm) or more. In some embodiments, the minimum distances D1 may be between about nineteen millimeters (19 mm) and about twenty-one millimeters (21 mm) (e.g., about twenty millimeters (20 mm)). In such embodiments, the chain links of a chain 150 (shown in FIG. 5) positioned within the chain channel 138 may have a height (measured vertically top to bottom when the chain 150 is positioned within the chain channel 138) of between about eight millimeters (8 mm) and about ten millimeters (10 mm), and at least some of the chain pins 152 used to join the chain links may have a height (measured vertically top to bottom when the chain is positioned within the chain channel 138) that is between about sixteen millimeters (16 mm) and about twenty millimeters (20 mm), but just smaller than the minimum distance D1. In this configuration, such a chain 150 having one or more relatively long chain pins 152 that protrude from the chain links (e.g., have a height that is about double the height of the chain links) may be positioned within a chain channel 138 without trimming the relatively long chain pins 152.

The chain guide structure 120 also may include a roller guide member 142 on each lateral side of the central beam 123 vertically below the chain guide members 126. Each roller guide member 142 may include a laterally extending portion 144. Although not shown, in additional embodiments, each roller guide member 142 may also include a vertically extending portion similar in configuration to the vertically extending portions 130 of the chain guide members 126. Roller channels 146 may be defined on each side of the central beam 123 by the spaces over the laterally extending portions 144 of the roller guide members 142. In some embodiments, the roller guide members 142 may be identical in shape to the chain guide members 126, but may be larger in size compared to the chain guide members 126 such that the roller channels 146 are larger than the chain channels 138.

The longitudinal ends of each segment of the chain guide structure 120 may be provided with pin holes 148 or recesses. During assembly and installation of the chain guide structure 120, one segment of the chain guide structure 120 may be installed by fastening that segment to another component of the overhead support system 112. Alignment pins (not shown) then may be inserted into the pin holes 148 of the installed segment of the chain guide structure 120 such that the pins protrude out from the pin holes 148, and the protruding portions of the pins may be inserted into the pin holes 148 of the next adjacent segment of the chain guide structure 120 to be installed to ensure proper alignment between the two adjacent segments of the chain guide structure 120 during installation.

As shown in FIG. 4, the attachment flanges 124 may project laterally outward from the central beam 123 by a larger distance than do the chain guide members 126 and the roller guide members 142. For example, the attachment flanges 124 may project laterally outward from the central beam 123 beyond the laterally outward ends of the chain guide members 126 and the roller guide members 142 by minimum distances D2. In some embodiments of the invention, these minimum distances D2 may be about eight millimeters (8 mm) or more, about ten millimeters (10 mm) or more, or even about twelve millimeters (12 mm) or more. In some embodiments, the minimum distances D2 may be between about ten millimeters (10 mm) and about twelve millimeters (12 mm) (e.g., about eleven millimeters (11 mm)). In such embodiments, the fasteners (e.g., screws, bolts, nails, etc.) used to secure the chain guide structure 120 to another component of the overhead support system 112 by passing the fasteners through the attachment flanges 124 at an orientation at least substantially perpendicular to the attachment flanges 124 and parallel to the central beam 123 and into another component of the overhead support system 112 to secure the chain guide structure 120 to the overhead support system 112 without interfering spatially with the chain guide members 126 or the roller guide members 142. For example, an electric drill could be used to insert screws through the attachment flanges 124 at an orientation at least substantially perpendicular to the attachment flanges 124 without the chain guide members 126 or the roller guide members 142 interfering with the screws or the drill.

As one particular non-limiting example, the attachment flanges 124 may project laterally outward from the central beam 123 by about thirty-five millimeters (35 mm), and the chain guide members 126 and the roller guide members 142 may project laterally outward from the central beam 123 by about twenty-four millimeters (24 mm), such that the attachment flanges 124 may project laterally outward from the central beam 123 by about eleven millimeters (11 mm) (which is the distance D2) more than the chain guide members 126 and the roller guide members 142.

Such a configuration provides an advantage over previously known curved chain guide structures, wherein, due to constraints of the manufacturing techniques used to form such curved chain guide structures, the attachment flanges do not project laterally beyond the chain guide members or the roller guide members. As a result, the fasteners used to secure such previously known curved chain guide structures are passed through the attachment flanges at an acute angle to both the attachment flanges and the central beam and tend to draw the chain guide structure laterally to one side or the other as they are inserted, which makes it difficult to establish and maintain proper alignment of the segments of the curved chain guide structures through a curved path during installation.

Previously known curved chain guide structures were manufactured by extruding straight segments of the chain guide structures, and subsequently bending the extruded segments. Because the compressive and tensile stresses within any particular region of the chain guide structure during bending is proportional to the distance from the bending plane (i.e., the plane 122 shown in FIG. 4 that extends vertically through the center of the central beam 123), the stresses in the laterally outward most regions of the chain guide structures can exceed the yield strength of the material during bending, which might results in cracks or other unacceptable strain deformation in the chain guide structures. As a result, previously known curved chain guide structures have been formed to have a maximum width of about fifty-five millimeters (55 mm) or less. Furthermore, driving fasteners, such as screws, through the attachment flanges at an orientation at least substantially perpendicular to the attachment flanges and parallel to the central beam may reduce or eliminate bending and/or shearing forces on the fasteners, and may reduce both lateral and vertical deflection of the chain guide structure.

Figure 5:
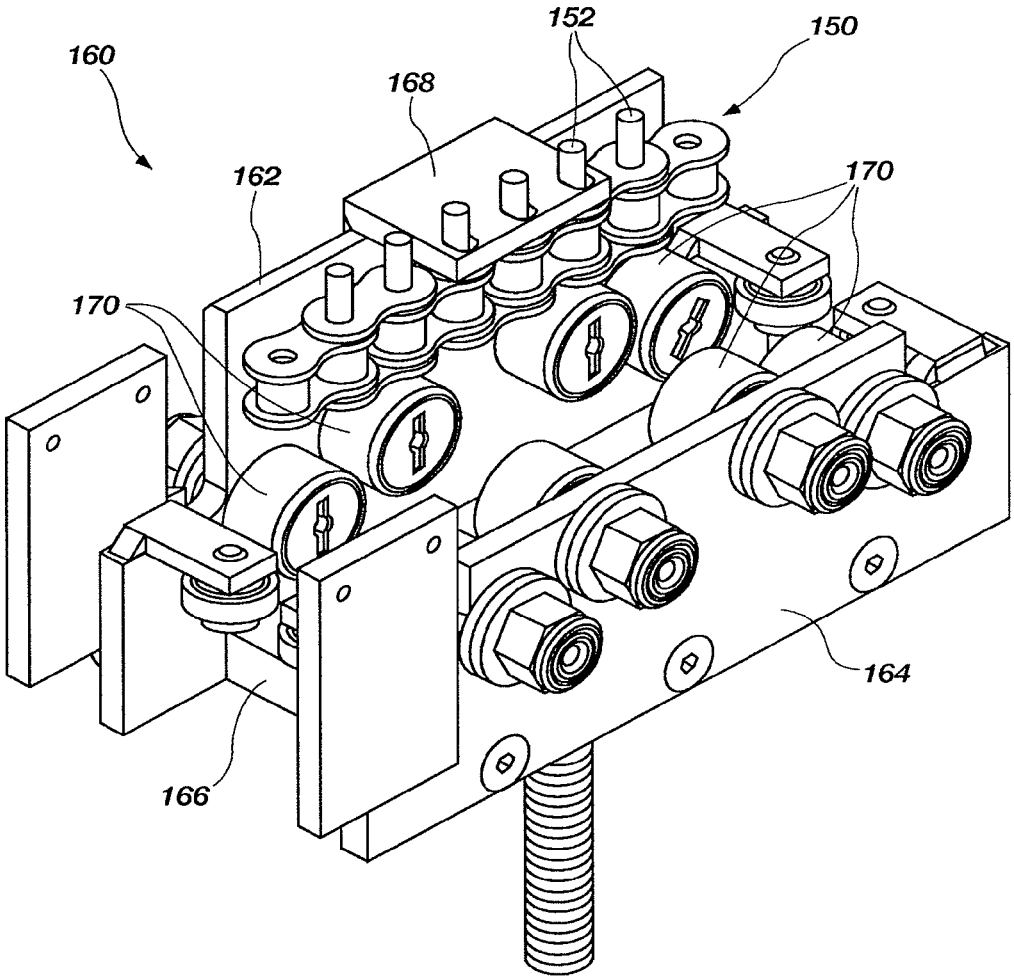
FIG. 5 is a perspective view of a trolley configured to roll along the chain guide shown in FIG. 4 and a section of chain coupled to the trolley.

FIG. 5 illustrates a trolley 160 that is configured to roll along the chain guide structure 120 (FIG. 4). The trolley 160 may be attached to the movable partition 102, and may be attached to a chain 150 that extends through a chain channel 138 of the chain guide structure 120. Only a segment of the chain 150 to which the trolley 160 is attached is illustrated in FIG. 5 to simplify the figure. As shown in FIG. 5, the trolley 160 may include a frame structure, which may include a first side bracket 162, a second side bracket 164, and a horizontal bracket 166 extending between and coupling together the first side bracket 162 and the second side bracket 164. Rollers 170 may be mounted to each of the first side bracket 162 and the second side bracket 164, and may be located and configured to be positioned within the roller channels 146 of the chain guide structure 120 (FIG. 4) when the trolley 160 is coupled with and supported by the chain guide structure 120. At least some of the rollers 170 may be supported by the top surfaces of the laterally extending portions 144 of the roller guide members 142 (FIG. 4). In other words, the trolley 160 may be suspended from the chain guide structure 120 by rollers 170 that abut against and roll along the upper surfaces of the laterally extending portions 144 of the roller guide members 142 within the roller channels 146 (FIG. 4).

The trolley 160 may further include a chain attachment plate 168, which may be attached to one of the first side plate 162 and the second side plate 164, and to portions of the chain pins 152 that project vertically from the chain links of the chain 150, as shown in FIG. 5. For example, the chain attachment plate 168 may include holes that extend therethrough, through which the projecting portions of the chain pins 152 extend.

The trolley 160 may be attached, for example, to the lead post 116 of the movable partition 102, as schematically illustrated in FIG. 2. The sheets 103A, 103B of panels 104 also may be coupled to the trolley 160, in place of, or in addition to, the lead post 116.

The chain 150 may comprise a circular or "looped" chain (as opposed to a linear chain having free ends) and may extend within and along each of the chain channels 138 along the length of the chain guide structure 120, and looping around the ends of the chain guide structure 120. A motor 180 (FIG. 2) may be mounted, for example, in the pocket 108 in the wall 110A, and a sprocket 182 may be mounted to a drive shaft of the motor 180. The sprocket 182 may comprise teeth that may be engaged with the chain 150, such that the motor 180 may be used to rotate the chain 150 through the chain guide structure 120. As the trolley 160 is attached to the chain 150 by way of the chain attachment plate 168 and the chain pins 152, rotation of the chain 150 by the motor 180 causes the trolley 160 to roll along the chain guide structure 120. As the trolley 160 may be attached to a leading end of the movable partition 102, the movable partition 102 may be extended and retracted using the motor 180.

Referring again to FIG. 4, in some embodiments of the present invention, the chain guide structure 120 may have a maximum width W1 of about sixty millimeters (60 mm) or more, about seventy millimeters (70 mm) or more, or even about seventy-five millimeters (75 mm) or more. Such chain guide structures 120 may be fabricated using certain fabrication techniques without resulting in the formation of cracks or other unacceptable strain deformation in the chain guide structures 120 during fabrication.

In accordance with additional embodiments of the present invention, a curved chain guide structure 120 may be fabricated using what is referred to in the art as a "stretch-forming" process. A straight chain guide structure 120 may be fabricated using, for example, an extrusion process, after which the straight chain guide structure 120 may be bent using a stretch-forming process.

Figure 6A:
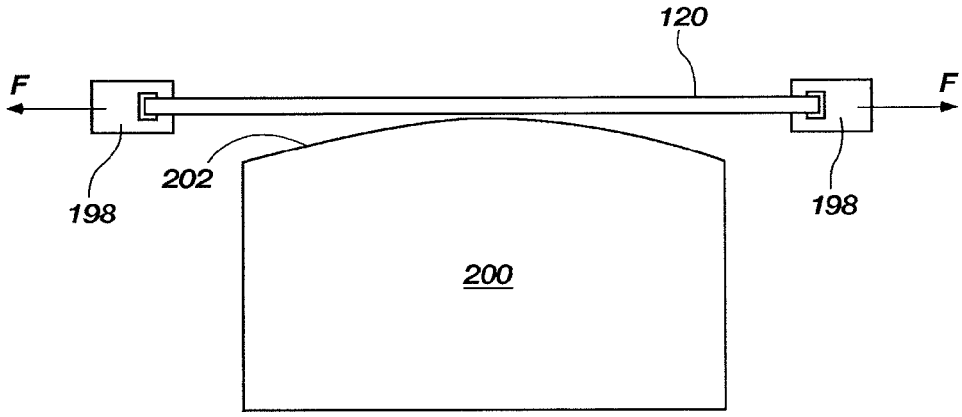
FIGS. 6A and 6B schematically illustrate a stretch forming process that may be used to form a chain guide like that shown in FIG. 4 in accordance with additional embodiments of the invention.
Figure 6B:
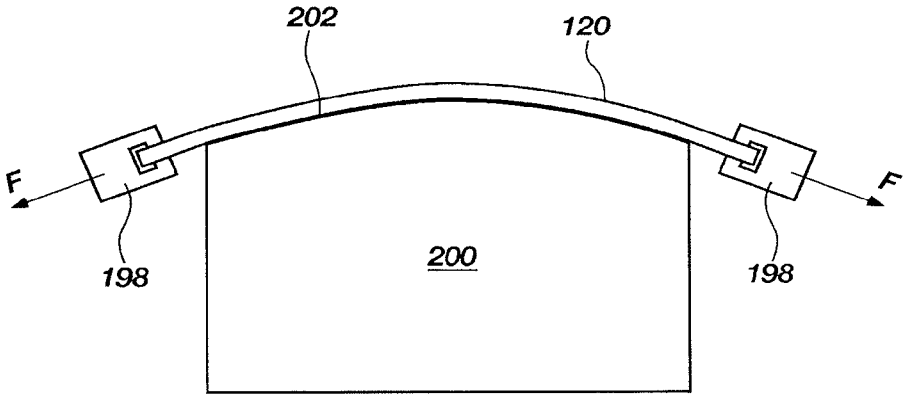

FIGS. 6A and 6B schematically illustrate a stretch-forming process being used to bend a chain guide structure 120 like that shown in FIG. 4. Referring to FIG. 6A, in the stretch-forming process, a chain guide structure 120, which is originally straight upon extrusion (as shown in FIG. 6A), may be stretched by applying a tensile force F to the chain guide structure 120 that results in tensile stress within the chain guide structure 120 that exceeds the yield point of the material of the chain guide structure 120. Machine clamps 198 may be used to grip the ends of the chain guide structure 120 for applying a tensile force F to the chain guide structure 120. While the tensile stress within the chain guide structure 120 that exceeds the yield point of the material of the chain guide structure 120, the chain guide structure is bent around the curved profile of a surface 202 of a die 200, as shown in FIG. 6B. By way of example, the stretch-forming process used to form the chain guide structure 120 may comprise a stretch-forming process as described in U.S. Pat. No. 2,464,169, which issued Mar. 8, 1949 to Bentley, or in U.S. Pat. No. 2,693,637, which issued Apr. 7, 1998 to Peabody et al., each of which patents is incorporated herein in its entirety by this reference.

Although embodiments of chain guide structures as described herein may be advantageously employed in embodiments of moveable partition systems that include a movable partition configured to extend along a curved path, it is understood that straight chain guide structures may be fabricated to have any combination of the elements and features of the bent chain guide structures as described herein, and that such straight chain guide structures and systems including such chain guide structures are also considered to be embodiments of the present invention. For example, a straight chain guide structure may be fabricated to have a shape and configuration as shown in FIG. 4.

While the invention may be susceptible to various modifications and alternative forms, specific embodiments have been shown by way of example in the drawings and have been described in detail herein. However, it should be understood that the invention is not intended to be limited to the particular forms disclosed. For example, elements and features of any embodiment described herein may be combined with other elements and features of other embodiments described herein to provide further advantageous embodiments of the invention. Thus, the invention includes all modifications, equivalents, and alternatives falling within the spirit and scope of the invention as defined by the following appended claims.

What is claimed is:

1. A method of forming an overhead support system for a movable partition system, comprising:

forming an at least substantially straight elongated unitary body, comprising:

forming a longitudinally extending and vertically oriented central beam;

forming a pair of attachment flanges extending laterally from a top end of the central beam; and forming a pair of chain guide members each comprising a first portion extending laterally from the central beam vertically below the pair of attachment flanges, a second portion extending vertically upward from the first portion, a channel defined above the first portion and between the second portion and the central beam, and one or more protrusions extending from the second portion and partially covering the channel, the attachment flanges of the pair of attachment flanges projecting laterally outward from the central beam beyond laterally outward ends of the chain guide members of the pair of chain guide members; and bending the at least substantially straight elongated unitary body while applying a tensile force to the at least substantially straight elongated unitary body resulting in tension within the at least substantially straight elongated unitary body higher than a yield point of a material of the at least substantially straight elongated unitary body.

2. The method of claim 1, wherein forming an at least substantially straight elongated unitary body comprises extruding the at least substantially straight elongated unitary body.

3. The method of claim 1, wherein bending the at least substantially straight elongated unitary body comprises bending the at least substantially straight elongated unitary body around a curved profile of a surface of a die.

4. The method of claim 1, further comprising providing the at least substantially straight elongated unitary body with a maximum width of at least about sixty millimeters (60 mm).

5. The method of claim 1, further comprising forming the attachment flanges of the pair of attachment flanges to project laterally outward from the central beam beyond laterally outward ends of the chain guide members of the pair of chain guide members by at least about eight millimeters (8 mm).

6. The method of claim 1, further comprising forming the at least substantially straight elongated unitary body to comprise one of an aluminum-based metal alloy and an iron-based metal alloy.

7. A method of installing an overhead support system for a movable partition system, comprising:

forming an at least substantially straight elongated unitary body, comprising:

forming a longitudinally extending and vertically oriented central beam;

forming a pair of attachment flanges extending laterally from a top end of the central beam; and forming a pair of chain guide members each comprising a first portion extending laterally from the central beam vertically below the pair of attachment flanges, a second portion extending at least substantially vertically from a distal end of the first portion, and an inward protrusion extending from a distal end of the second portion at least substantially laterally toward the central beam, the attachment flanges of the pair of attachment flanges projecting laterally outward from the central beam beyond laterally outward ends of the chain guide members of the pair of chain guide members;

bending the at least substantially straight elongated unitary body while applying a tensile force to the at least substantially straight elongated unitary body resulting in tension within the at least substantially straight elongated unitary body higher than a yield point of a material of the at least substantially straight elongated unitary body; and inserting fasteners at least substantially perpendicularly through the attachment flanges of the pair of attachment flanges and at least substantially parallel to the central beam.

8. The method of claim 7, further comprising selecting the fasteners to comprise at least one of screws, bolts, and nails.

9. The method of claim 7, wherein each chain guide member further comprises an outward protrusion extending laterally from the central beam toward the distal end of the second portion.

* * * * *

UNITED STATES PATENT AND TRADEMARK OFFICE

CERTIFICATE OF CORRECTION

PATENT NO. : 8,356,654 B2
APPLICATION NO. : 13/294420
DATED : January 22, 2013
INVENTOR(S) : W. Michael Coleman, Michael D. George and Mark B. Laraway It is certified that error appears in the above-identified patent and that said Letters Patent is hereby corrected as shown below:

On the title page:
In ITEM (56) References Cited

COLUMN 2, LINE 3, change "7/1972" to --7/1973--

Signed and Sealed this
Sixteenth Day of December, 2014

Michelle K. Lee

Michelle K. Lee
*Deputy Director of the United States Patent and Trademark Office*